US005425979A

United States Patent [19]

Lueghamer

[11] Patent Number: 5,425,979

[45] Date of Patent: Jun. 20, 1995

[54] CONCRETE PROTECTION SHEET WITH SIGNALLING AND REFLECTIVE LAYER

[75] Inventor: Albert Lueghamer, Bad Hall, Austria

[73] Assignee: "agru" Alois Gruber Gesellschaft m.b.H., Bad Hall, Austria

[21] Appl. No.: 184,101

[22] Filed: Jan. 21, 1994

[30] Foreign Application Priority Data

Jan. 22, 1993 [DE] Germany ..... 9300859 U

[51] Int. Cl.[6] ..... B32B 3/00

[52] U.S. Cl. ..... 428/195; 428/207; 428/212; 264/274

[58] Field of Search ..... 52/309.17, 245.19; 264/274; 428/344, 369.1, 403, 195, 207, 212

[56] References Cited

U.S. PATENT DOCUMENTS 3,089,191 5/1963 Conrad .
3,759,481 9/1973 Scott ..... 249/189
5,168,682 12/1992 Rye ..... 52/309.17
5,268,137 12/1993 Scott et al. ..... 264/225

FOREIGN PATENT DOCUMENTS

0436058A1 7/1991 European Pat. Off. .

*Primary Examiner*—Patrick J. Ryan
*Assistant Examiner*—William A. Krynski
*Attorney, Agent, or Firm*—Nikaido, Marmelstein, Murray & Oram

[57] ABSTRACT

A method and apparatus for lining concrete structure elements includes a plastic sheet. The plastic sheet has a first layer formed of a heat-reflective material of a first color, with a plurality of attachments disposed on a first side thereof. A second layer is disposed upon a second side of the first layer. The second layer is formed of a material of a second color different from the first color. Reduced thermal expansion, improved concrete/liner bonding, and improved identification of defects is thereby provided.

11 Claims, 3 Drawing Sheets

CONCRETE PROTECTION SHEET WITH SIGNALLING AND REFLECTIVE LAYER

BACKGROUND OF THE INVENTION

1. Field of the Invention

The invention relates to a plastic sheet, in particular for lining construction elements formed of cementitious material such as concrete, which is preferably made of thermoplastic and is provided with attachments on one side thereof. Protection sheets made of plastic, so-called knubbed sheets, are used in particular in concrete tank construction in cases where it is necessary to produce liquid-tight, gas-tight, chemically resistant tanks. The plastic sheets form the lining of such tanks; they provide the resistance to the chemicals and liquids. The mechanical strength of the entire structure is essentially provided by the concrete structure. In general, the bonding of the plastic sheets to the concrete structure poses difficulties, since a smooth plastic sheet does not form a firm mechanical bond to the concrete. The assistance of adhesives does not provide long-term satisfactory results.

For these reasons, various anchoring elements, including those with undercuts, have been proposed. These anchoring elements are attached to one side of the plastic sheet and, during the production of the tank, are embedded in the surface of the concrete to be protected, typically the inner surface. The desired firm bond between the plastic sheet and concrete structure can be achieved in this manner.

2. Description of the Related Art

European Patent Application 436 058 A1 teaches an economically desirable process for producing knubbed sheets from plastic, and a knubbed sheet of this kind. This relates in particular to the integral production of plastic sheets having undercut knubs, which have thoroughly proven their desirability.

However, it has been found that such plastic sheets, which generally consist of dark to black plastic, require special precautions on the construction site. In particular, during installation in the concrete structure, relatively high thermal expansion occurs, for example when they are installed under direct sunlight. This expansion must be anticipated. The plastic sheets are nailed to the formwork of the concrete structure and then have to be protected against direct sunlight to prevent the excessive thermal expansion. In addition, mechanical damage to these plastic sheets, even when they are installed, can only be recognized with great difficulty. In the interests of safety, however, such damage must be repaired as soon as practicable.

SUMMARY OF THE INVENTION

The object of the invention is to provide a plastic sheet for lining concrete construction elements which has a comparatively low to negligible thermal expansion even under direct sunlight, and which in addition provides a signalling or alerting function in the presence of relatively serious mechanical damage or cracks.

This object is achieved according to the invention in that the sheet comprises two layers, the layer receiving the attachments being heat-reflective in design and the opposite layer consisting of material of a different color.

In the preparation for the installation of the plastic sheet according to the invention, the plastic sheet is applied, typically nailed or otherwise fastened, to the formwork of the concrete or cementitious structure to be produced. At this stage, because of the heat-reflective design of the layer facing the possible direct sunlight, special precautions are no longer needed to minimize any incidence of sunlight. Because of the heat-reflective design of the top layer, possibly including the knubs discussed above, there is significantly less heating of the plastic sheet than before, and therefore a virtually negligible thermal expansion of the sheet. Special protective measures to prevent the heating of the sheet before its installation can thus be dispensed with. At the same time, because of the different coloration of the layer having the knubs or attachments and the layer opposite this or bearing against this, a signalling effect is obtained if, in particular in the installed state, the opposite layer, which is then the top, covering layer, is seriously mechanically damaged. In this case the reflective layer is visible because of its different color with respect to the further layer bearing against it, so that there is an indication that a repair is needed.

According to the invention, it is therefore advisable for the layer receiving the attachments or knubs to consist of relatively light plastic and the opposite layer of comparatively dark plastic. The light plastic layer is, as desired, fundamentally heat-reflective in case of possible damage, it can then be particularly readily distinguished with respect to the dark plastic layer.

According to a further feature of the invention, it is advisable for the knubs or attachments to be provided such that they are undercut on and integral with the sheet. In this manner, on the one hand there is the possibility of economical production of the sheet, while on the other hand an especially good anchoring in the concrete is made possible by the undercuts.

BRIEF DESCRIPTION OF THE DRAWINGS

Further details, features and advantages of the invention result from the following description of an exemplary embodiment of the invention and also with reference to the drawings and the claims, wherein:

DETAILED DESCRIPTION OF THE PREFERRED EMBODIMENTS

Figure 1:
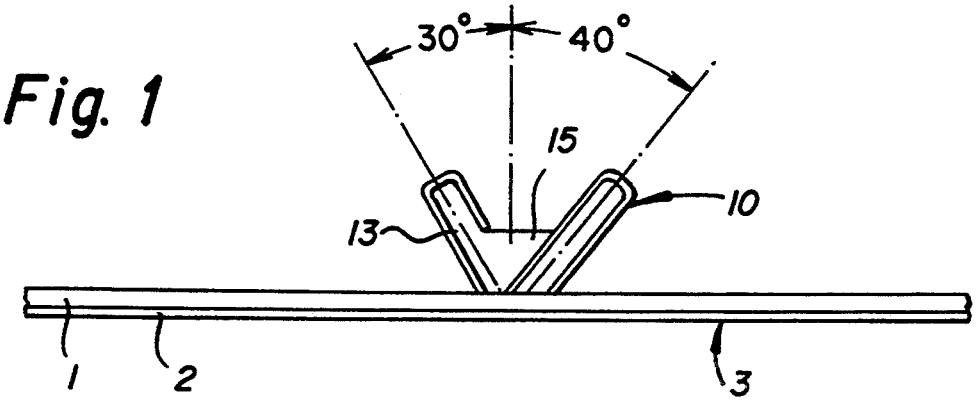
FIG. 1 shows a partial side view of the plastic sheet according to the invention.

The construction of the concrete protection sheet according to the invention with a signalling and protective layer is shown in FIG. 1. The plastic sheet or knubbed sheet 3 consists of a heat-reflective layer 1 with attachments or knubs 10 which are preferably produced integrally with the heat-reflective layer 1. The heat-reflective layer 1 has firmly bonded to it a further layer 2 which is of a color which contrasts with the heat-reflective layer. For practical reasons, the heat-reflective layer is produced together with the knubs 10, preferably from a light color plastic, such as white. The layer 2 bearing against it is generally dark brown or black in color. With this coloration, the desirable effects listed above are achieved. In the case of direct sunlight on the light layer 1, there is a pronounced heat reflection. An impermissible thermal expansion of the plastic sheet is thereby avoided. If damage to this heat-reflective layer or to the dark layer 2 occurs during rough construction site operation, this can be readily identified because of the contrasting coloration, so that a repair which may be necessary is clearly indicated.

Figure 2:
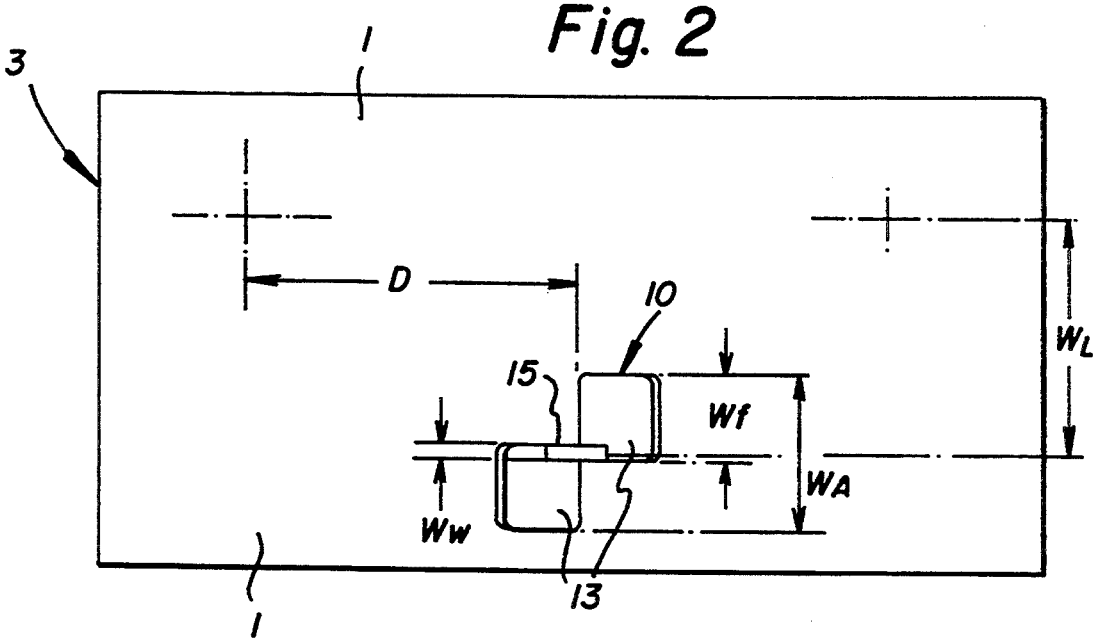
FIG. 2 shows a plan view of the subject-matter of FIG. 1.
Figure 3:
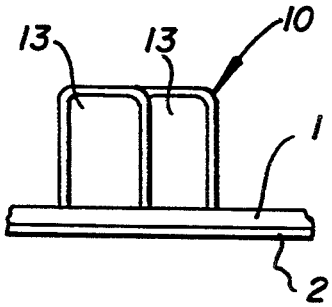
FIG. 3 shows a partial side view of the subject-matter of FIG. 1.
Figure 4A:
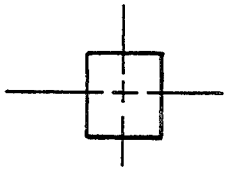
FIGS. 4(*a*)–4(*d*) illustrate alternative embodiments of the invention, directed to a section along line IV—IV of FIG. 1.
Figure 4B:
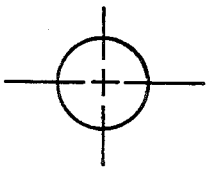
Figure 4C:
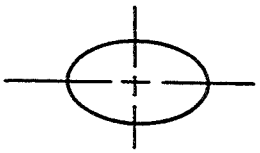
Figure 4D:
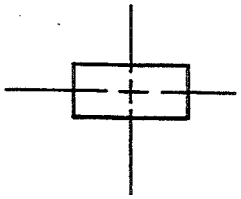

FIGS. 1 to 3 show an exemplary embodiment of the plastic sheet according to the invention, a unit of an attachment or a knub being shown in FIG. 3, whereas two further identical attachments are indicated in the drawing only by means of two symmetrical lines. These indicated attachments are all identical in design to the attachment unit 10. As can be seen in FIGS. 1 to 3, an attachment 10 comprises two fins or fin elements 13 which, in the exemplary embodiment drawn, are arranged with respect to the layer 1 such that their main axes enclose an angle of 30° and 40° respectively with respect to the perpendicular to the layer 1. All attachments 10 are provided in the same manner with respect to the layer 1. As can be seen in particular from the plan view according to FIG. 2 and the side view according to FIG. 3, a web or spacer 15 is mounted in the angular space of 70° between the two fins 13. The web serves to secure the position of the two fins 13 with respect to one another, which is of advantage in particular in the demolding operation of the attachment units 10, where a certain force has to be exerted on the attachments or attachment units 10 in order to remove them from the recesses of the production mold or calender. However, this web 15 is also important when embedding the plastic sheet according to the invention in concrete when the weight forces of the not fully hardened concrete act on the fins 13. In this case, too, the webs 15 of the fins 13 perform a stiffening function and thus ensure maintenance of the undercut overall shape of the attachments 10, so as to ensure reliable anchoring of the attachments and thus of the entire plastic sheet 3 in the concrete element.

Some measurement details of attachments 10 in mm are given by way of example in FIG. 2. From these it can be seen that the width Wf of the fins 13 is approximately 11 mm, the distance D of the attachments from one another is 40 mm and the lateral displacement LD of two attachments is approximately 29 mm. The width Ww of the web 15 is approximately 4 mm, the entire width of an attachment unit 10, which is formed from two fins, is approximately 20 mm.

The lateral displacement of the fins 13 of an attachment unit 10 takes place virtually over their entire width of 11.3 mm, minus the thickness of the web. However, this lateral displacement may also be chosen smaller, but in the arrangement shown there results an optimal effectiveness of the attachment unit 10 as anchoring element and optimal deformability from the roll of the calender. Furthermore, the shape of the fins is not restricted to the flat design shown. In addition to the rectangular shape shown, the individual fins 13 may rather also be round, oval and square, seen in a section normal to the longitudinal axis of the fins, as shown in FIG. 4.

Materials which may be used for the plastic sheet are polyvinyl chloride, polypropylene, polyethylene, polyvinylidene fluoride and E-CTFE.

The production of the plastic sheet according to the invention takes place in a manner analogous to that described in EP 0 436 058 A1. In addition to the production of the knubbed sheet described there, in the present case from light to white thermoplastic, the dark to black layer 2 or sheet is produced on a second calender and subsequently fed to the last—seen in the transport direction—roll nip of the calender for producing the heat-reflective layer 1 provided with knubs. In this manner an intimate bonding or welding of the layers 1 and 2 occurs.

The use of a dark to black plastic for the layer 2 provides the plastic sheet according to the invention with UV resistance when installed. Layer 2, as mentioned above, forms the outer layer of the plastic sheet with respect to the concrete structure.

Knubbed sheets made of plastic are used in particular in concrete tank construction in cases when it is necessary to produce liquid-tight and also gas tight, chemically resistant tanks. The plastic sheets form the lining of such tanks. They provide the resistance to the chemicals and liquids. The mechanical strength of the entire structure is essentially provided by the concrete structure. In general, the bonding of the plastic sheets to the concrete structure poses difficulties, since the smooth plastic sheet does not form a firm mechanical bond to the concrete. The assistance of adhesives does not lead to long-term satisfactory results.

For these reasons, various anchoring elements, including those with undercuts, have been proposed, which are attached to one side of the plastic sheet and, during the production of the tank, are embedded in the concrete. Although this produces the desired firm bond between the plastic sheet and concrete substructure, the attachment of the known anchoring elements to the plastic sheets is comparatively complicated, since it is carried out retroactively and requires several operations.

One known process is one in which separately produced anchor knubs are simultaneously mounted on the plastic sheet and fastened there by welding. This type of attachment of anchor knubs is extremely time-consuming in view of the multiplicity of anchor elements to be attached, or a correspondingly complicated device is required. Furthermore, these anchor knubs have, in the region of their base, sharp-edged transitions within themselves and with respect to the plastic sheet, as a result of which notch stresses with the known overloadings may be produced.

Another known process is one with which lining sheets are produced by extrusion. During the extrusion, as a result of the extrusion operation, anchor strips, which may also be undercut, are provided on one sheet side over the entire sheet length. This process can only be used for relatively thick plastic sheets to ensure a uniform construction of the anchor strips. The latter also effect a linear force transmission between the plastic sheets and the concrete of the structure. This results in a non-uniform stress profile in the sheet, counteracting its fatigue strength.

Another known process is one for the extrusion of knubbed sheets in which, however, the knubs of the plastic sheet which are produced on a calendar additionally have to be guided through a cutting device to produce the undercuts which are intended for subsequently fastening the knubbed sheet in the concrete tank. Because the undercuts are possible only in a relatively restricted manner, the knubbed sheets produced in this way are not capable of covering all requirements. In addition, the additional operation of attaching the undercuts increases costs. Also, special measures must be taken for carrying away and collecting the cut-off plastic parts.

U.S. Pat. No. 3,089,191 describes a production process for knubbed sheets by means of extrusion and calendaring. In the hook-shaped attachments produced there, although conical connection pieces to the plastic sheet are provided at their base to avoid disadvantageous notch stresses there, the hook itself, however, has an attachment extending at right angles to the base part, with the consequence that high notch stresses are in turn established at the transition from the base part to the attachment, with the increased possibility of cracking under loading. Furthermore, when this previously known knubbed sheet is installed, strong one-sided loading occurs at the hook, since the attachments, extending parallel to the sheet, of the hooks generally extend in a single direction and thus lead to a one-sided load distribution.

Figure 5:
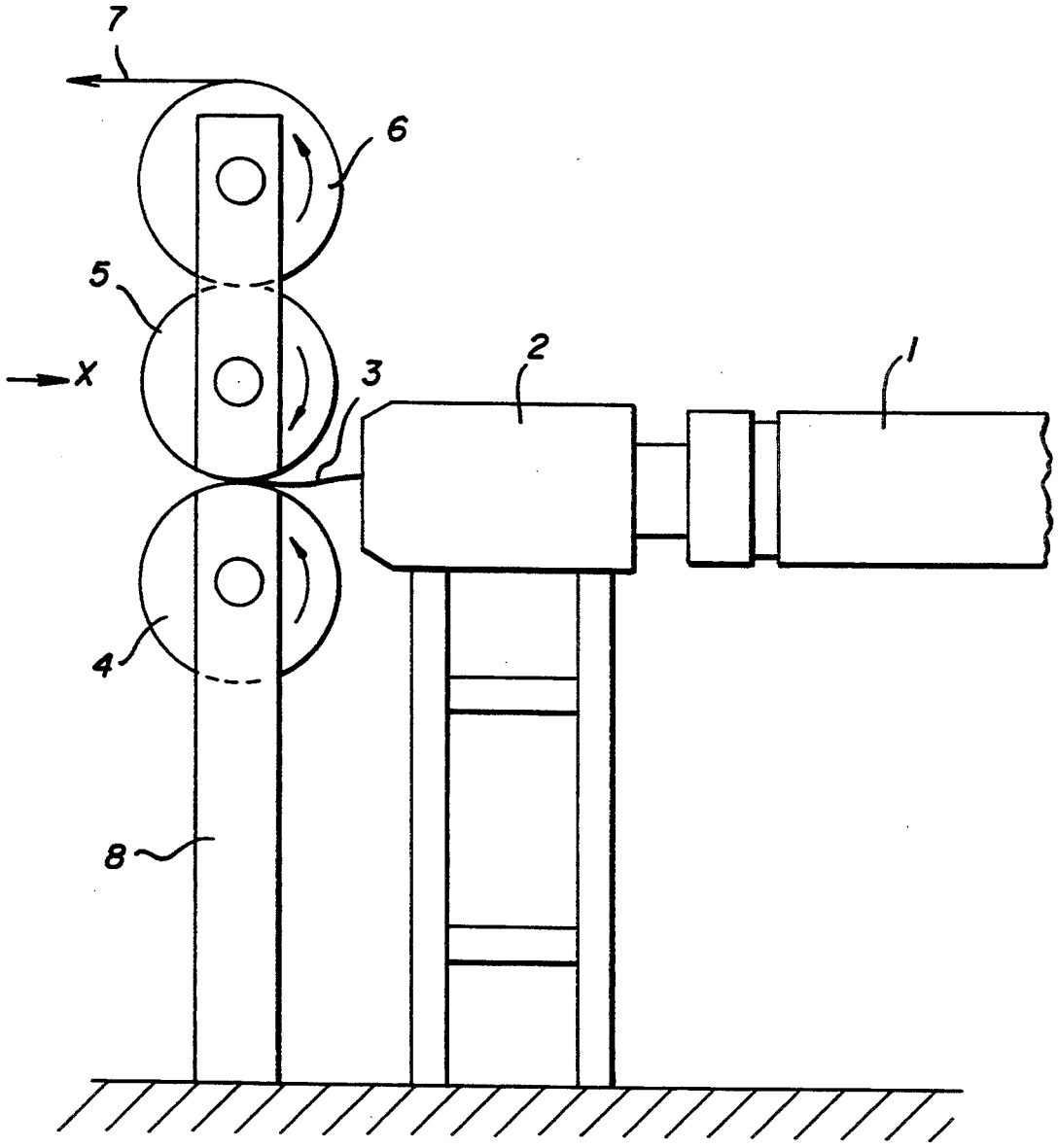
Fig. 5 PRIOR ART
FIG. 5 illustrates an apparatus for manufacturing a sheet according to EP 436 058 A1.

The system for producing such sheets is shown in FIG. 5, and consists of an extruder with a downstream die, which is designed as a slot die in order, in this manner, to produce a sheet blank. The latter is introduced into the nip formed by two rolls and led around two rolls 5 and 6. One of the rolls is essentially a polishing roll. The plastic sheet which is finished in principle at one roll and has knubs or attachments is then led off at another roll. Subsequently, the web-shaped plastic sheet can be subdivided and cut to commercial sizes.

For the production of the plastic sheet as noted above, provided with attachments, the center roll of the three rolls shown on the calendar is provided with specific recesses distributed over its circumference. The recesses in the roll for producing these attachments, however, naturally correspond to these attachments.

Recesses for producing the attachments are incorporated into inserts, which in turn are recessed into the roll, thereby maintaining a smooth surface, and are fastened there by means of screws. The inner ends of the recesses are connected to a vent line in each case, by means of which it is ensured that no counterpressure is built up when the plastic composition penetrates into the recesses, and that therefore complete filling of the recesses with the plastic composition is ensured. The vent lines are connected to the atmosphere. They may also be connected to subatmospheric pressure lines. The arrangement of the recesses in the inserts, which in turn are provided in corresponding recesses in the roll, serves for the cost-efficient production of this tool. The technically demanding recesses are easier to produce in the inserts, which can be better handled, than would be possible on the comparatively large roll.

Materials which come into consideration for the plastic sheet are polyvinyl chloride, polypropylene, polyethylene, polyvinylidene fluoride and E-CTFE.

With these plastics, the working temperatures of the roll are approximately 90° C., in the case of the center roll approximately 60° C. The take-off rate of the finished plastic sheet at the roll is approximately 10 to 20 meters per hour, depending on the thickness of the sheet. This relatively low take-off rate is necessary so that the sheet base and the attachments 10 can be demoulded while maintaining their described shape and arrangement with respect to one another.

The recesses for the fins with the angle of 30° with respect to the perpendicular through the sheet base are, in this connection, arranged on the roll opposite the recesses for the fins with the angle of 40° such that the fins with the angle of 30° are leading with respect to the fins with 40° . By this means, there results a satisfactory demouldability of the undercut attachments from the recesses. At the described working temperatures and working rate, the fins are flexible and plastic to such an extent that the forces to be exerted on the attachments during demoulding no longer leads to a permanent deformation of the attachments with respect to the structure described.

We claim:

1. A plastic sheet for lining construction elements formed of cementitious material, said plastic sheet comprising:

a first layer, said first layer being formed of a heat-reflective material of a first color, and having a plurality of attachments disposed on a first side thereof, said attachments being integrally provided on said first layer, and being undercut; and a second layer disposed upon a second side of said first layer, said second layer being formed of a material of a second color, said second color contrasting with said the first color.

2. A plastic sheet as recited in claim 1, wherein said first layer is formed of a light-color plastic material, and said second layer is formed of a dark-color plastic material.

3. A plastic sheet as recited in claim 1, wherein each or said attachments comprise at least two spreading fin elements.

4. A plastic sheet as recited in claim 3, wherein one spreading fin element of each of said at least two spreading fin elements is disposed at a different angle to said first side of said first layer than a second spreading fin element of said at least two spreading fin elements.

5. A plastic sheet as recited in claim 3, wherein said fin elements are square in a section normal to a longitudinal axis thereof.

6. A plastic sheet as recited in claim 3, wherein said fin elements are round in a section normal to a longitudinal axis thereof.

7. A plastic sheet as recited in claim 3, wherein said fin elements are elliptical in a section normal to a longitudinal axis thereof.

8. A plastic sheet as recited in claim 3, wherein said fin elements are oval in a section normal to a longitudinal axis thereof.

9. A plastic sheet as recited in claim 3, wherein said at least two spreading fin elements includes a spacer connected therebetween, said spacer extending over approximately one-half of a height of each fin element.

10. A plastic sheet as recited in claim 3, wherein said at least two spreading fin elements are disposed to be offset with respect to each other, with a spacer connecting said fin elements and disposed at a central point between opposite ends of the at least two spreading fin elements.

11. A plastic sheet as recited in claim 3, wherein one of said at least two spreading fin elements is disposed at an angle of approximately 30° to a line perpendicular to said surface of said first layer, and a second of said at least two fin elements is disposed at an angle of approximately 40° to the perpendicular line.

* * * * *